US010494221B2

(12) United States Patent
Harris et al.

(10) Patent No.: US 10,494,221 B2
(45) Date of Patent: Dec. 3, 2019

(54) METHOD AND SYSTEM FOR SPLICING NOSE WIRE IN A FACEMASK MANUFACTURING PROCESS

(71) Applicant: Avent, Inc., Alpharetta, GA (US)

(72) Inventors: Nathan Craig Harris, Canton, GA (US); Joseph P. Weber, Suwanee, GA (US); Ajay Y. Houde, Johns Creek, GA (US); David Lamar Harrington, Cumming, GA (US); Mark Thomas Pamperin, Cumming, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 0 days.

(21) Appl. No.: 15/768,120

(22) PCT Filed: Oct. 16, 2015

(86) PCT No.: PCT/US2015/055861

§ 371 (c)(1),
(2) Date: Apr. 13, 2018

(87) PCT Pub. No.: WO2017/065784

PCT Pub. Date: Apr. 20, 2017

(65) Prior Publication Data

US 2018/0312368 A1 Nov. 1, 2018

(51) Int. Cl.
*B65H 69/06* (2006.01)
*B65H 67/02* (2006.01)
(Continued)

(52) U.S. Cl.
CPC ..... *B65H 69/06* (2013.01); *A41D 13/11* (2013.01); *B65H 67/02* (2013.01); *B65H 69/00* (2013.01);
(Continued)

(58) Field of Classification Search
CPC ..... B65H 69/00; B65H 69/06; B65H 67/02; B65H 2701/36; B65H 19/14; B65H 19/20;
(Continued)

(56) References Cited

U.S. PATENT DOCUMENTS 3,670,474 A 6/1972 Vieson et al.
3,847,046 A 11/1974 Schmermund
(Continued)

FOREIGN PATENT DOCUMENTS

CA 828007 A 11/1969
CA 2 325 975 A1 5/2002
(Continued)

OTHER PUBLICATIONS

International Search Report and Written Opinion for PCT/US2015/055861, dated Jun. 22, 2016, 13 pages.

*Primary Examiner* — William E Dondero
(74) *Attorney, Agent, or Firm* — Dority & Manning, P.A.

(57) ABSTRACT

A method and associated system are provided for splicing a reserve nose wire to a running nose wire in a facemask production line, wherein the running nose wire is supplied continuously from a supply roll. Prior to depletion of the running nose wire, the supply roll is moved from an operating location to an intermediate location that is further from the production line while continuing to supply the running nose wire from the supply roll. The supply roll is then moved from the intermediate location back towards the production line while decelerating the supply roll to a stop, thereby creating an accumulation of the running wire functionally between the supply roll and the production line. With the supply roll at a stop, the running nose wire is continuously supplied from the accumulation and a leading end of a reserve roll of nose wire is spliced to the running nose wire at a location upstream of the accumulation where the run-
(Continued)

ning nose wire is at a standstill. The running nose wire is then cut at a location upstream of the splice such that the reserve nose wire and reserve roll become a new running nose wire and new supply roll in the production line.

20 Claims, 5 Drawing Sheets

(51) Int. Cl.
*B65H 69/00* (2006.01)
*A41D 13/11* (2006.01)
*A62B 23/02* (2006.01)

(52) U.S. Cl.
CPC ..... *A41D 13/1123* (2013.01); *A62B 23/025* (2013.01); *B65H 2701/36* (2013.01)

(58) Field of Classification Search
CPC .... A41D 13/11; A41D 13/1123; A62B 23/025
See application file for complete search history.

(56) References Cited

U.S. PATENT DOCUMENTS

| | | | |
|---|---|---|---|
| 3,983,774 | A | 10/1976 | Seragnoli |
| 4,543,152 | A | 9/1985 | Nozaka |
| 5,117,614 | A | 6/1992 | Johnsen |
| 5,155,967 | A | 10/1992 | Branson |
| 5,170,610 | A | 12/1992 | Tisma |
| 5,322,061 | A | 6/1994 | Brunson |
| 5,724,677 | A | 3/1998 | Bryant et al. |
| 5,727,369 | A | 3/1998 | Mosse |
| 6,173,712 | B1 | 1/2001 | Brunson |
| 6,174,397 | B1 | 1/2001 | Johnson |
| 6,524,423 | B1 | 2/2003 | Hilt et al. |
| 6,729,103 | B1 | 5/2004 | Hartness et al. |
| 7,703,260 | B1 | 4/2010 | Watkins |
| 2002/0095913 | A1 | 7/2002 | Honegger |
| 2003/0010422 | A1 | 1/2003 | Starkey |
| 2004/0144619 | A1 | 7/2004 | Ohiro et al. |
| 2004/0262127 | A1 | 12/2004 | Harnish et al. |
| 2006/0070353 | A1 | 4/2006 | Van Dam |
| 2008/0072721 | A1 | 3/2008 | Kern |
| 2008/0251210 | A1 | 10/2008 | Chen |

FOREIGN PATENT DOCUMENTS

| | | | |
|---|---|---|---|
| EP | 0 257 852 | A2 | 3/1988 |
| EP | 0 622 298 | A1 | 11/1994 |
| EP | 0 640 526 | A1 | 3/1995 |
| EP | 0 791 537 | A1 | 8/1997 |
| EP | 0 806 343 | A2 | 11/1997 |
| EP | 0 894 752 | A1 | 2/1999 |
| EP | 1 048 595 | A1 | 11/2000 |
| EP | 1 757 552 | A2 | 2/2007 |
| EP | 1 840 033 | A2 | 10/2007 |
| EP | 2 484 611 | A2 | 8/2012 |
| EP | 2 757 062 | A1 | 7/2014 |
| EP | 2 801 790 | A1 | 11/2014 |
| FR | 1.588.621 | | 4/1970 |
| GB | 364557 | | 12/1931 |
| GB | 1 216 310 | | 12/1970 |
| GB | 1 232 053 | | 5/1971 |
| GB | 1 361 496 | | 7/1974 |
| GB | 2 092 090 | A | 8/1982 |
| KR | 100550225 | B1 | 2/2006 |
| WO | WO 97/32494 | | 9/1997 |
| WO | WO 02/28760 | A1 | 4/2002 |
| WO | WO 2005/05406 | A1 | 6/2005 |

-Prior Art-

-Prior Art-

*-Prior Art-*

METHOD AND SYSTEM FOR SPLICING NOSE WIRE IN A FACEMASK MANUFACTURING PROCESS

FAMILY OF RELATED APPLICATIONS

The present application is related by subject matter to the following concurrently filed PCT applications (all of which designate the US):

a. International Application No.: PCT/US2015/055858; entitled "Method and System for Splicing Nose Wire in a Facemask Manufacturing Process".

b. International Application No.: PCT/US2015/055863; entitled "Method and System for Introducing a Reserve Nose Wire in a Facemask Production Line".

c. International Application No.: PCT/US2015/055865; entitled "Method and System for Cutting and Placing Nose Wires in a Facemask Manufacturing Process".

d. International Application No.: PCT/US2015/055867; entitled "Method and System for Placing Nose Wires in a Facemask Manufacturing Process".

e. International Application No.: PCT/US2015/055871; entitled "Method and System for Placing Nose Wires in a Facemask Manufacturing Process".

f. International Application No.: PCT/US2015/055872; entitled "Method and System for Placing Nose Wires in a Facemask Manufacturing Process".

g. International Application No.: PCT/US2015/055876; entitled "Method and System for Wrapping and Preparing Facemasks for Packaging in a Facemask Manufacturing Line".

h. International Application No.: PCT/US2015/055878; entitled "Method and System for Automated Stacking and Loading Wrapped Facemasks into a Carton in a Facemask Manufacturing Line".

i. International Application No.: PCT/US2015/055882; entitled "Method and System for Automated Stacking and Loading of Wrapped Facemasks into a Carton in a Facemask Manufacturing Line".

The above cited applications are incorporated herein by reference for all purposes. Any combination of the features and aspects of the subject matter described in the cited applications may be combined with embodiments of the present application to yield still further embodiments of the present invention

FIELD OF THE INVENTION

The present invention relates generally to the field of protective facemasks, and more specifically to a method and associated system for splicing nose wire supplies in the manufacturing of such facemasks.

BACKGROUND OF THE INVENTION

Various configurations of disposable filtering facemasks or respirators are known and may be referred to by various names, including "facemasks", "respirators", "filtering face respirators", and so forth. For purposes of this disclosure, such devices are referred to generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 masks/minute. Current facemask production lines are capable of producing only about 100 masks/minute due to technology and equipment restraints, which falls far short of the estimated goal. Accordingly, advancements in the manufacturing and production processes will be needed if the goal of "on demand" facemasks during a pandemic is to become a reality.

The various configurations of filtration facemasks include a flexible, malleable metal piece, known as "nose wire", along the edge of the upper filtration panel to help conform the facemask to the user's nose and retain the facemask in place during use, as is well known. The nose wire may have a varying length and width between different sizes and mask configurations, but is generally cut from a spool and encapsulated or sealed in nonwoven material layers during the in-line manufacturing process. For mass production at the throughputs mentioned above, as the spool is depleted, it will be necessary to splice a reserve spool into the running line while maintaining the high production speeds of the running line.

The present invention addresses this need and provides a method and associated system for high speed splicing of a nose wire into a running in-line production of facemasks.

SUMMARY OF THE INVENTION

Objects and advantages of the invention will be set forth in the following description, or may be obvious from the description, or may be learned through practice of the invention.

In accordance with aspects of the invention, a method is provided for splicing a reserve nose wire to a running nose wire in a facemask production line, wherein the running nose wire is supplied continuously from a supply roll and the splicing operation does not necessitate a stoppage or slowdown of consequence in the production line.

It should be appreciated that the present inventive method is not limited to any particular style or configuration of facemask that incorporates a nose wire, or to the downstream facemask production steps.

The method includes, prior to depletion of the running nose wire, moving the supply roll from an operating location to an intermediate location that is spaced further from the production line while continuing to supply the running nose wire from the supply roll. The supply roll is then moved back from the intermediate location towards the production line while decelerating the supply roll to a stop. The supply roll may be moved completely back to the original operating location, or some other location. This movement of the supply roll results in formation of an accumulation of the running wire functionally between the supply roll and the production line, for example in the form of one or more loops or folds of the running nose wire.

The method may further comprise initially accelerating the supply roll when moving the supply roll from the intermediate position back towards the production line so as to add to the accumulation prior to decelerating and stopping the supply roll.

Proceeding further, with the supply roll at a stop, the running nose wire is supplied from the accumulation (i.e., the accumulation is drawn down while the supply roll is at a stop). Also, with the supply roll at a stop, a leading end of a reserve roll of nose wire is introduced to the running nose wire at a location upstream of the accumulation where the running nose wire is at a standstill. The leading end of the reserve nose wire is spliced to the running nose wire at this location.

Subsequent to the splice, the running nose wire is cut at a location upstream of the splice such that the reserve nose wire and reserve roll become a new running nose wire and new supply roll in the production line.

In one embodiment, the reserve roll is moved with the supply roll from the operating location to the intermediate position. Alternately, the supply roll can be staged at a location so as to remain stationary (e.g., at a location adjacent to the operating position of the supply roll) while the supply roll is moved to form the accumulation.

In a particular embodiment, the supply roll is functionally mounted on a movable carriage proximate to the production line, wherein the carriage is controlled to move from the operating location to the intermediate location to create the accumulation of running nose wire. With this embodiment, the reserve roll may also be functionally mounted on the movable carriage. In addition, the splice may be performed with a conventional splicer that is also mounted on the movable carriage.

For creating the splice, the leading end of the reserve roll may be clamped (e.g., held in position) in the splicer until after formation of the accumulation, wherein the leading end is then released and the reserve roll is rotated to introduce the leading end of reserve nose wire onto the running nose wire in the splicer at the location upstream of the accumulation.

The method may further include, subsequent to cutting of the running nose wire, removing what is left of the supply roll from the production line, moving the reserve roll into the operating position to become the new supply roll, and moving an additional reserve roll into a standby position for a subsequent splicing procedure.

The splice may be performed with a splice cabinet that is positioned upstream of a location of the accumulation. This cabinet may be fixed in position relative to the production line, or may be a portable unit that brought into an operating position upstream of the accumulation when needed. The splice cabinet may be movable with the supply roll between the operating position and the intermediate position.

Embodiments of the method may further include sensing transport speed of the running nose wire through the production line and calculating the amount of accumulation necessary for performing the splice with the supply roll at a stop as a function of the transport speed.

In order to properly time the splice, certain embodiments may include sensing a depletion state of the running nose wire and timing the splicing as a function of the sensed depletion state. For example, at a given sensed diameter of a roll of the running nose wire, the splice sequence can be initiated.

The present invention also encompasses various system embodiments for splicing a reserve nose wire to a running nose wire in a facemask production line in accordance with the present methods, as described and supported herein.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

As mentioned, the present methods relate to splicing of a reserve nose wire to a running nose wire in a facemask production line. The downstream facemask production steps are not limiting aspects of the invention and, thus, will not be explained in great detail herein.

Also, the present disclosure refers to or implies conveyance or transport of certain components of the facemasks through the production line. It should be readily appreciated that any manner and combination of article conveyors (e.g., rotary and linear conveyors), article placers (e.g. vacuum puck placers), and transfer devices are well known in the article conveying industry and can be used for the purposes described herein. It is not necessary for an understanding and appreciation of the present methods to provide a detailed explanation of these well-known devices and system.

Various styles and configurations of facemasks that incorporate a nose wire are well known, including flat pleated facemasks, and the present methods may have utility in the production lines for these conventional masks. For illustrative purposes only, aspects of the present method are described herein with reference to a particular type of respirator facemask often referred to in the art as a "duckbill" mask, as illustrated in FIG. 1.

Figure 1:
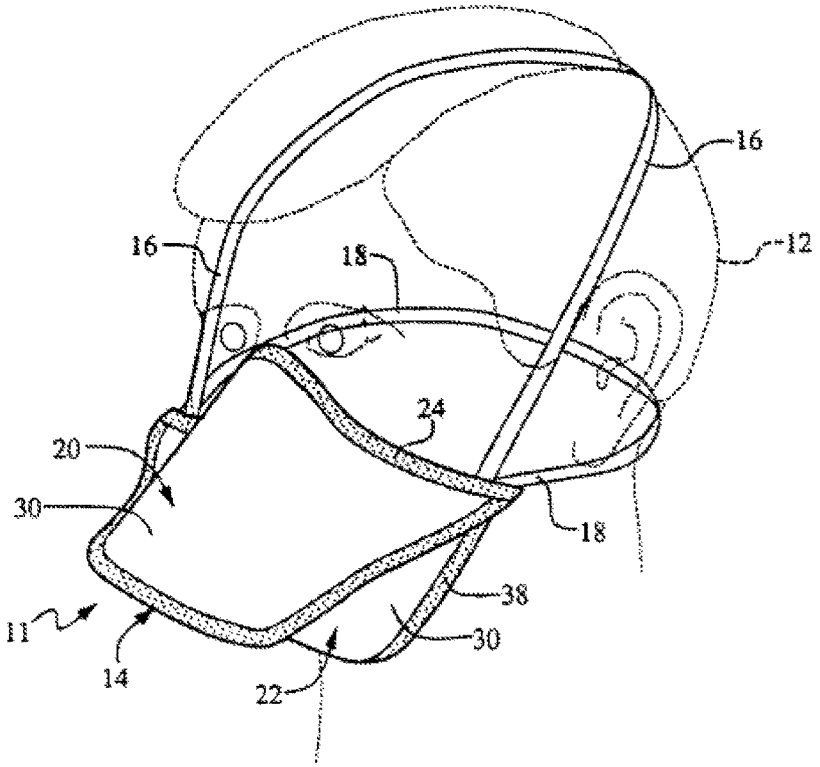
FIG. 1 is a perspective view of a conventional respiratory facemask worn by a user, the facemask incorporating a nose wire to conform the facemask to the user's face.
Figure 2:
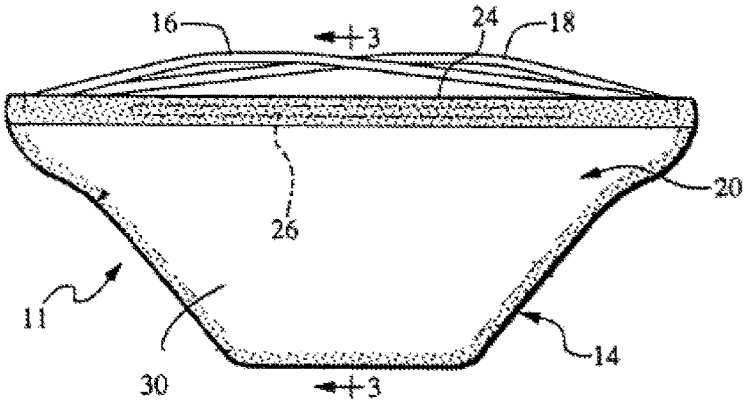
FIG. 2 is a top view of the conventional facemask of FIG. 1 is a folded state.
Figure 3:
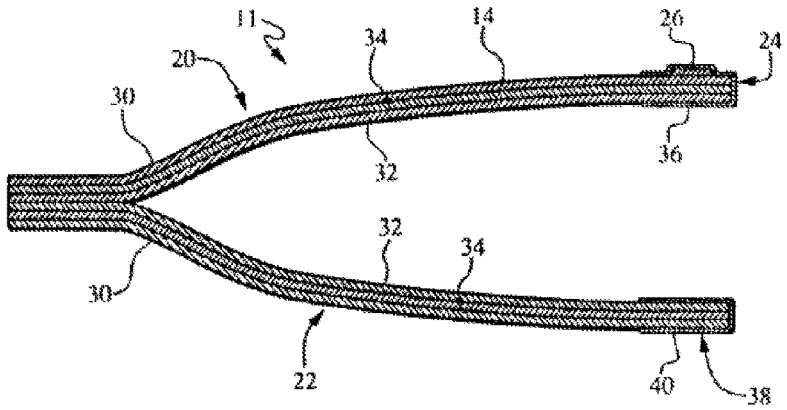
FIG. 3 is a cross-sectional view of the facemask of FIG. 2 taken along the lines indicated in FIG. 2.

Referring to FIGS. 1-3, a representative facemask 11 (e.g., a duckbill facemask) is illustrated on the face of wearer 12. The mask 11 includes filter body 14 that is secured to the wearer 12 by means of resilient and elastic straps or securing members 16 and 18. The filter body 14 includes an upper portion 20 and a lower portion 22, both of which have complimentary trapezoidal shapes and are preferably bonded together such as by heat and/or ultrasonic sealing along three sides. Bonding in this manner adds important structural integrity to mask 11.

The fourth side of the mask 11 is open and includes a top edge 24 and a bottom edge 38, which cooperate with each other to define the periphery of the mask 11 that contacts the wearer's face. The top edge 24 is arranged to receive an elongated malleable member 26 (FIGS. 2 and 3) in the form of a flat metal ribbon or wire (referred to herein as a "nose wire"). The nose wire 26 is provided so that top edge 24 of mask 11 can be configured to closely fit the contours of the nose and cheeks of wearer 12. The nose wire 26 is typically constructed from an aluminum strip with a rectangular cross-section. With the exception of having the nose wire 26 located along top edge 24 of the upper portion 20 of the mask 11, the upper and lower portions 20 and 22 may be identical.

As shown in FIG. 1, the mask 11 has the general shape of a cup or cone when placed on the face of wearer 12 and thus provides "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing.

Blow-by associated with normal breathing of wearer 12 is substantially eliminated by properly selecting the dimension and location of the nose wire 26 with respect to top edge of 24. The nose wire 26 is preferably positioned in the center of top edge 24 and has a length in the range of fifty percent (50%) to seventy percent (70%) of the total length of the top edge 24.

As illustrated in cross-sectional view of FIG. 3, the upper and lower portions 20 and 22 may include multiple layers and each have an outer mask layer 30 and inner mask layer 32. Located between outer and inner mask layers 30, 32 are one or more intermediate filtration layers 34. These layers are typically constructed from a melt-blown polypropylene, extruded polycarbonate, melt-blown polyester, or a melt-blown urethane.

The top edge 24 of the mask 11 is faced with an edge binder 36 that extends across the open end of mask 11 and covers the nose wire 26. Similarly, the bottom edge 38 is encompassed by an edge binder 40. Edge binders 36 and 40 are folded over and bonded to the respective edges 24, 30 after placement of the nose wire 26 along the top edge 24. The edge binders 36, 40 may be constructed from a spun-laced polyester material.

Figure 4:
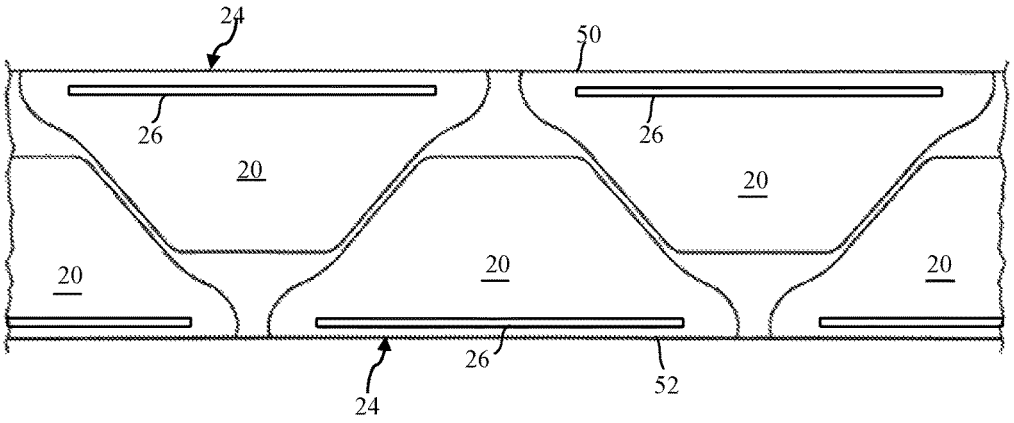
FIG. 4 is a top view of a web having a plurality of facemask panels defined therein, with a nose wire incorporated in edges of alternating panels in the web.

FIG. 4 illustrates the layout of the generally trapezoidal shape for cutting the layers forming the upper body portions 20. A similar layout would be produced for the lower body portion 22, which is then brought into alignment with and bonded to the upper body portion 20 in the facemask manufacturing line. More precisely, the layouts of FIG. 4 represent the outline of cutters which ultimately cut layers 30 and 32 for the upper portion 20 from respective flat sheets of material, with the layouts arranged in an alternating pattern on the flat sheets of material between edges 50, 52 representing the open side of mask 11 formed by top edge 24 and bottom edge 38. The arrangement of the layouts is such that a continuous piece of scrap 54 is formed as the material is fed through the cutter (not shown) utilized in making mask 11. FIG. 4 illustrates placement of cut nose wires 26 on the portions of the continuous web corresponding to the top edge 24 prior to folding and bonding of the edge binders 36, 40 along the edges 24, 38.

Figure 5:
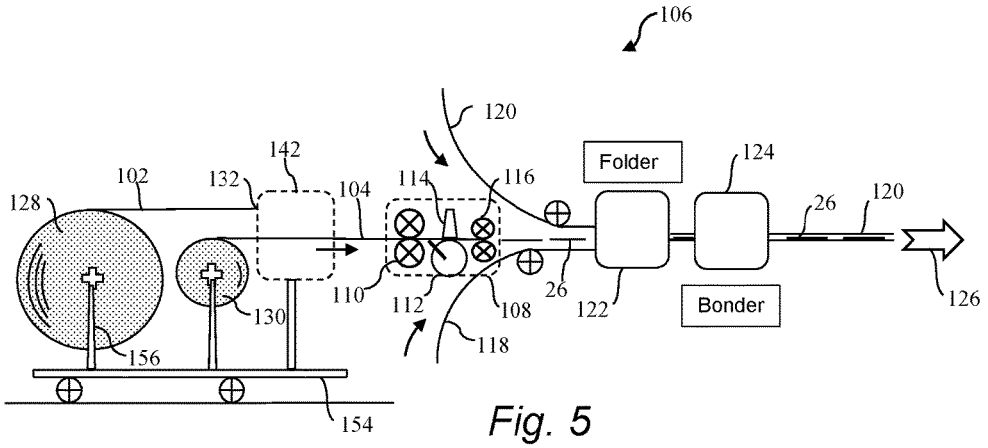
FIG. 5 is a schematic depiction of parts of a facemask production line in accordance with aspects of the invention related to feeding and cutting of nose wires for subsequent incorporation with facemask panels.

FIG. 5 depicts portions of a production line 106 for facemasks that incorporate a nose wire 26. A running nose wire 104 is supplied in continuous strip form from a source, such as a driven operational running roll 130, to a cutting station 108. Suitable cutting stations 108 are known and used in conventional production lines. The station 108 may include a set of feed rollers 110 that define a driven nip, wherein one of the feed rollers is driven and the other may be an idler roll. The feed rollers 110 may also serve to impart a crimped pattern to the running nose wire, such as diamond pattern. The running nose wire is fed to a cutter roller 112 configured opposite to an anvil 114, wherein the cuter roller 112 is driven at a rate so as to cut the running nose wire 104 into individual nose wires 26. Downstream of the cutter roller 112, a pair of delivery rollers 116 transports the individual nose wires 26 from the cutting station 108 onto a carrier web 118. Referring to FIG. 4, this carrier web 118 may be the continuous multi-layer web that defines the upper and lower body portions 20, 22, wherein the individual nose wires 26 are deposited along the edge of the carrier web 118 corresponding to the top edge 24. It should be appreciated that an additional cutting station may be operationally disposed opposite to (and upstream or downstream) of the cutting station 108 for cutting and placing the nose wires on the opposite nested upper body portions 20 in the web depicted in FIG. 4. For the sake of ease of understanding only one such cutting station is illustrated and described herein.

FIG. 5 also depicts staging of a roll 128 of reserve nose wire 102 having a leading end 132. Upon a predetermined depletion state of the running nose wire 104, the leading end 132 of the reserve nose wire 102 is spliced with the running nose wire 104 without stopping or substantially slowing the overall running speed of the production line 106, as explained in greater detail below with reference to FIGS. 6 through 9.

After placement of the individual nose wires 26 in position on the carrier web 118, the binder web 120 is introduced to the production line along both edges of the carrier web 118 (only one binder web 120 is depicted in FIG. 5.). The combination of carrier web 118, nose wire 26, and binder webs 120 pass through a folding station 122 wherein the binder webs 120 are folded around the respective running edges 50, 52 of the carrier web 118 (FIG. 4). The components then pass through a bonding station 124 wherein the binder webs 120 are thermally bonded to the carrier web 118, thereby producing the edge configurations 24, 38 depicted in FIG. 3 with respective binders 36, 40. The nose wire 26 is held in position relative to the top edge 24 by the binder 36.

From the bonding station 124, the continuous combination of carrier web 118 with nose wires 26 under the binder 36 is conveyed to further downstream processing stations 126 wherein the individual facemasks are cut, bonded, head straps are applied, and so forth.

Figure 6:
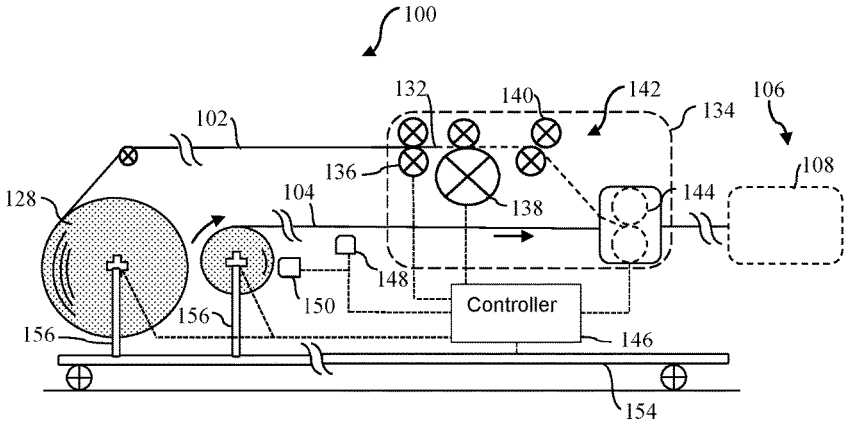
FIG. 6 is a schematic representation of aspects for splicing a reserve nose wire into a running production line in accordance with aspects of the invention.

With further reference to FIGS. 6 through 9, aspects of a method 100 are depicted for splicing the leading end 132 of the reserve nose wire 102 (FIG. 5) into the running production line 106 (FIG. 106). FIG. 6 depicts the reserve roll 128 in a staged stand-by position wherein the leading end 132 of the reserve nose wire 102 may be located at a desired position relative to a splicing station 142, which may be embodied within a stand-alone cabinet 134. For example, the leading end 132 may be threaded between a first set of feed rollers 136 at the splicing station 142 in the stand-by state. The reserve roll 128 and supply roll 130 are configured with an independent drive, which may be a drive roller or a driven spindle.

Figure 7:
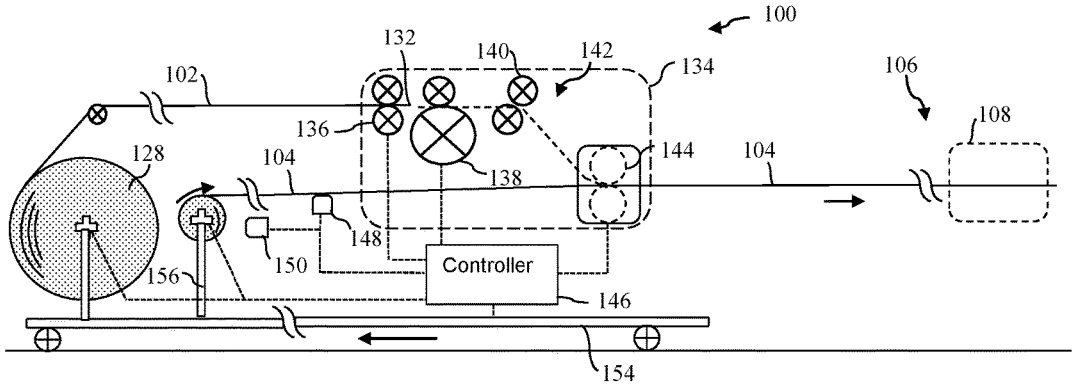
FIG. 7 is a schematic representation of further aspects for splicing a reserve nose wire into a running production line in accordance with aspects of the invention.

Referring to FIG. 7, the method 100 includes, prior to depletion of the running nose wire 104, moving the supply roll 130 from an operating location (FIG. 6) to an intermediate location that is spaced further from the production line 106 while continuing to supply the running nose wire 104 from the supply roll 130, as indicated by the arrows in FIG. 7.

Figure 8:
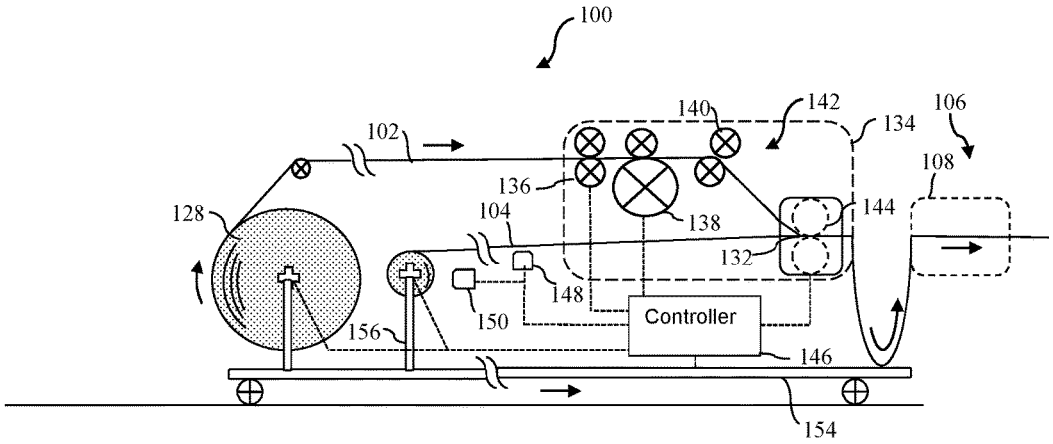
FIG. 8 is a schematic representation of still other aspects for splicing a reserve nose wire into a running production line in accordance with aspects of the invention.

Referring to FIG. 8, the supply roll 128 is then moved back from the intermediate location depicted in FIG. 7 towards the production line 106 while decelerating the supply roll 130 to a stop. The supply roll 130 may be moved completely back to the original operating location depicted in FIG. 6, or some other location relative to the production line 106. This movement of the supply roll 130 away from and back towards the production line 106 results in formation of an accumulation 152 of the running wire 104 functionally between the supply roll 130 and the production line 106, for example in the form of one or more loops or folds of the running nose wire 104 as depicted in FIG. 8.

In order to further increase the amount of running nose wire 104 in the accumulation 152, the method 100 may further include initially accelerating the supply roll 130 when moving the supply roll 130 from the intermediate position back towards the production line prior to decelerating and stopping the supply roll 130.

Still referring to FIG. 8, with the supply roll 130 at a stop, the running nose wire 104 is supplied from the accumulation 152. In other words, the accumulation 152 is drawn down while the supply roll 130 is at a stop. Also, with the supply roll 130 at a stop, the leading end 132 of the reserve roll 128 of nose wire is introduced to the running nose wire 104 at a location upstream (relative to the transport direction of the running nose wire 104) of the accumulation 152 where the running nose wire 104 is at a standstill. The leading end 132 of the reserve nose wire 102 is spliced to the running nose wire 104 in the splicing station 142 at this location.

Various splicing means may be employed at the splicing station 142, including adhesive application, spot welding/tacking, and so forth. In the embodiment depicted in the figures, the splicing station 142 may include first and second sets 136, 138 of controllably driven feed rollers. The first set of feed rollers 136 may be controlled by a controller 146 and used to clamp the leading end 132 of the reserve nose wire 102 in the stand-by status of the reserve roll 128. For splicing, the controller may initiate feeding by the first set of feed rollers 136 and the reserve roll 128 to advance the leading end 132 to a primary set of feed rollers 138, which are also controlled by the controller 146 and used to advance the leading end 132 through diverter rollers 140 and onto the running nose wire 104 (which is at a standstill while the accumulation 152 is being drawn down) just prior to a set of crimper rollers 144. These crimper rollers 144 are also controlled by the controller 146 to crimp the leading end 132 to the running nose wire 104, for example with a clamp or other known splicing devices.

Subsequent to the splice procedure, the running nose wire 104 is cut at a location upstream of the splice such that the reserve nose wire 102 and reserve roll 128 become a new running nose wire 104 and new supply roll 130 in the production line. In the illustrated embodiments, this cut may be made by a cutter roll 145 downstream of the crimper rollers 144, wherein one of the rollers 145 includes a cutting blade that cuts through the bottom running wire 104 without cutting through the top running reserve wire 102.

The supply roll 128 can be staged at a location so as to remain stationary (e.g., at a location adjacent to the operating position of the supply roll 130) while the supply roll 130 is moved to form the accumulation 152. In the embodiment depicted in the figures, the reserve roll 128 is moved with the supply roll 130 from the operating location (FIG. 6) to the intermediate position (FIG. 7). For example, the supply roll 128 may be functionally mounted on a movable carriage 154 via supports 156, wherein the carriage is controlled by the controller 146 to move from the operating location to the intermediate location to create the accumulation 152 of running nose wire 104. With this embodiment, the reserve roll 128 may also be functionally mounted on the movable carriage 154. In addition, the splice may be performed with a conventional splicer station 142 (which may include the crimper rollers 144 and cutter rollers 145) that is also mounted on the movable carriage 154.

Figure 9:
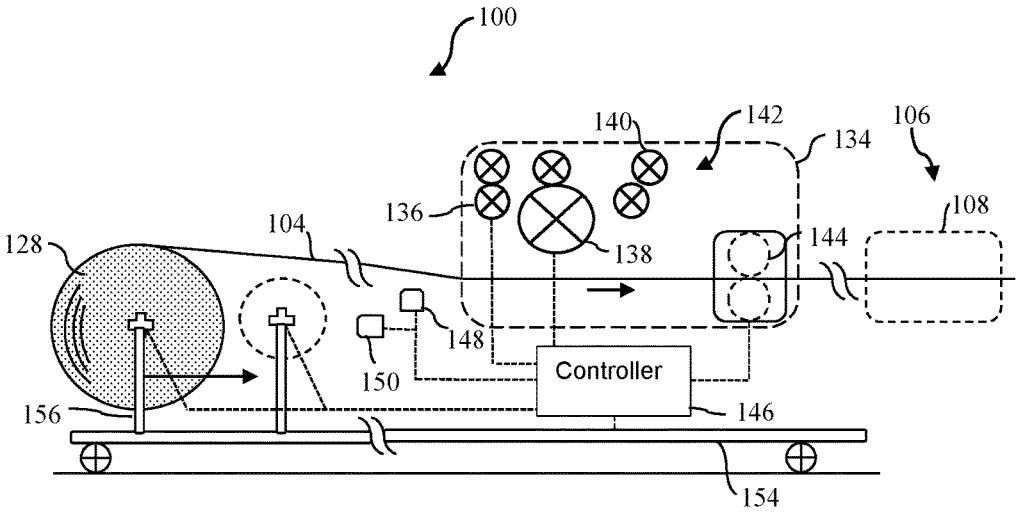
FIG. 9 is a schematic representation of additional aspects for splicing a reserve nose wire into a running production line in accordance with aspects of the invention.

As depicted in FIG. 9, the method 100 may further include, subsequent to cutting of the running nose wire 104, removing what is left of the supply roll 128 from the production line 106 (in particular, from the movable carriage 154) and then moving the reserve roll 128 into the operating position to become the new supply roll 130. For example, the roller supports 156 may be movable along the carriage 154 for this purpose. An additional reserve roll 128 may then be moved into a standby position for a subsequent splicing procedure.

In certain embodiments that can be inferred from the figures, the splice may be performed with a splice cabinet 134 that is positioned at the location upstream of the accumulation 152 where the running wire 104 is at a standstill. This cabinet 34 may be fixed in position relative to the production line 106, or may be a portable unit that brought into an operating position upstream of the accumulation 152 when needed. After the splice is complete, the splice cabinet 134 can be functionally disengaged from the production line 106 and moved to another location or different production line 106. In an alternative embodiment, the splice is performed by splice machinery that is permanently configured with the production line 106.

Alternatively, the splice cabinet 134 may be movable with the supply roll 130 between the operating position and the intermediate position. For example, the splice cabinet 134 may be functionally mounted on the movable carriage 154.

The controller 146 may be any configuration of control hardware and software to control the individual drives of the reserve roll 128, the supply roll 130, the first set of feed rollers 136, the primary feed rollers 138, the carriage 154, and the crimper rollers 144 in the sequence discussed above.

Various controls and associated sensors may be utilized to accomplish the splicing process. For example, in FIGS. 6 through 8, the transport speed of the running nose wire 104 is sensed by a sensor 148 in communication with the controller 146 and, based on this transport speed, the amount of accumulation 152 necessary for performing the splice with the supply roll 130 at a stop can be determined by the controller 146, wherein the carriage 154, the feed rollers 136, 138, the reserve roll 128, and the crimper rollers 144 are controlled accordingly to produce the needed accumulation 152.

In order to properly time the splice, certain embodiments may include sensing a depletion state of the running nose wire 104 and timing the splicing as a function of the sensed depletion state. For example, at a given sensed diameter of the running roll 130 determined by a sensor 150 in communication with the controller 146, the splice sequence can be initiated at a defined depletion state of the running wire 104.

As mentioned, the present invention also encompasses various system embodiments for splicing a reserve nose wire to a running nose wire in a facemask production line in accordance with the present methods. Aspects of such systems are illustrated in the figures, and described and supported above.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for splicing a reserve nose wire to a running nose wire in a facemask production line, the running nose wire supplied continuously from a supply roll, comprising:

prior to depletion of the running nose wire, moving the supply roll from an operating location to an intermediate location that is further from the production line while continuing to supply the running nose wire from the supply roll;

moving the supply roll from the intermediate location back towards the production line while decelerating rotation of the supply roll to a stop, thereby creating an accumulation of the running wire functionally between the supply roll and the production line;

with the supply roll at a stop, continuing to supply the running nose wire from the accumulation;

with the supply roll at a stop, splicing a leading end of a reserve roll of nose wire to the running nose wire at a location upstream of the accumulation where the running nose wire is at a standstill; and cutting the running nose wire at a location upstream of the splice such that the reserve nose wire and reserve roll become a new running nose wire and new supply roll in the production line.

2. The method as in claim 1, wherein the supply roll is moved from the intermediate location back to the operating location to create the accumulation of running nose wire.

3. The method as in claim 1, wherein the reserve roll is moved with the supply roll from the operating location to the intermediate position.

4. The method as in claim 1, wherein the supply roll is functionally mounted on a movable carriage proximate to the production line, wherein the carriage is controlled to move from the operating location to the intermediate location to create the accumulation of running nose wire.

5. The method as in claim 4, wherein the reserve roll is also functionally mounted on the movable carriage.

6. The method as in claim 5, further comprising performing the splice with a splicer that is also mounted on the movable carriage.

7. The method as in claim 6, wherein the leading end of the reserve roll is clamped in the splicer until after formation of the accumulation, wherein the leading end of the reserve nose wire is then released and the reserve roll is rotated to introduce the leading end of reserve nose wire onto the running nose wire at a location upstream of the accumulation for splicing.

8. The method as in claim 1, wherein subsequent to cutting of the running nose wire, the supply roll is removed from the production line, the reserve roll is moved into the operating position to become the new supply roll, and an additional reserve roll is moved into the standby position for a subsequent splicing procedure.

9. The method as in claim 1, wherein the splice is performed with a splice cabinet that is position upstream of a location of the accumulation.

10. The method as in claim 9, wherein the splice cabinet is fixed in location relative to the production line.

11. The method as in claim 9, wherein the splice cabinet is movable with the supply roll between the operating position and the intermediate position.

12. The method as in claim 1, further comprising sensing transport speed of the running nose wire and calculating the amount of accumulation necessary for performing the splice with the supply roll at a stop as a function of the transport speed.

13. The method as in claim 1, further comprising initially accelerating the supply roll when moving the supply roll from the intermediate position back towards the production line so as to add to the accumulation prior to decelerating and stopping the supply roll.

14. The method as in claim 1, further comprising sensing a depletion state of the running nose wire and timing the splicing of the reserve nose wire as a function of the sensed depletion state.

15. A system for splicing a reserve nose wire to a running nose wire in a facemask production line in accordance with the method of claim 1, the system comprising:

a supply roll of running nose wire that is movable relative to the production line;

a reserve roll of nose wire;

a cutting station;

delivery rollers downstream of the cutting station to transport individual nose wires from the cutting station onto a carrier web that defines a body portion of the facemasks made in the production line;

the reserve nose wire having a leading end, wherein upon a predetermined depletion state of the running nose wire, the leading end of the reserve nose wire is spliced to the running nose wire without stopping or substantially slowing an overall running speed of the production line;

wherein prior to depletion of the running nose wire, the supply roll of running nose wire is moved from an operating location to an intermediate location that is further from the production line while continuing to supply the running nose wire from the supply roll;

wherein the supply roll of running nose wire is subsequently moved from the intermediate location back towards the production line while decelerating rotation of the supply roll to a stop, thereby creating an accumulation of the running wire functionally between the supply roll of running nose wire and the production line; and a splicing station upstream of the accumulation, wherein, with the supply roll at a stop, the running nose wire is supplied from the accumulation while a leading end of the reserve roll of nose wire is spliced at the splicing station to the running nose wire and the running nose wire is cut at a location upstream of the splice such that the reserve nose wire and reserve roll become a new running nose wire and new supply roll in the production line.

16. The system as in claim 15, wherein the supply roll is mounted on a movable carriage.

17. The system as in claim 16, wherein a controller is configured with the carriage to move the carriage from the operating location to the intermediate location.

18. The system as in claim 16, wherein the reserve roll is also mounted on the movable carriage.

19. The system as in claim 16, wherein the splicing station is also mounted on the movable carriage.

20. The system as in claim 16, wherein the reserve roll and the splicing station are also mounted on the movable carriage.

* * * * *